US007268301B2

(12) United States Patent
Hosoya

(10) Patent No.: US 7,268,301 B2
(45) Date of Patent: Sep. 11, 2007

(54) LID OF FUEL TANK

(75) Inventor: Hajime Hosoya, Takasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/180,730

(22) Filed: Jul. 14, 2005

(65) Prior Publication Data

US 2006/0032662 A1 Feb. 16, 2006

(30) Foreign Application Priority Data

Jul. 15, 2004 (JP) ..... 2004-208530

(51) Int. Cl.
*H01R 9/22* (2006.01)

(52) U.S. Cl. ..... 174/151; 174/135; 439/544; 439/722; 439/550; 439/565

(58) Field of Classification Search ..... 174/151, 174/135; 439/544, 722, 550, 565
See application file for complete search history.

(56) References Cited

U.S. PATENT DOCUMENTS 6,260,540 B1 * 7/2001 Hiraiwa et al. ..... 123/497
2004/0018780 A1 * 1/2004 Mott et al. ..... 439/722

FOREIGN PATENT DOCUMENTS

EP 1 591 370 A1 11/2005
JP 10-299599 A 11/1998

* cited by examiner

*Primary Examiner*—Jinhee Lee
(74) *Attorney, Agent, or Firm*—Sughrue Mion, PLLC

(57) ABSTRACT

A lid of a fuel tank that includes a lid body constructed of a molded plastic and shaped and sized to be put in an opening formed in a wall of the fuel tank. The lid body has a first portion that is exposed to the interior of the fuel tank when the lid is put in the opening of the wall and a second portion that is projected laterally from a major portion of the lid body over a peripheral area of the opening of the wall when the lid is put in the opening of the wall. The lid further includes a wiring embedded and extending in the lid body. The wiring has a first end exposed to the outside of the lid body from the first portion of the lid body and a second end exposed to the outside of the lid body from the second portion of the lid body.

10 Claims, 3 Drawing Sheets

LID OF FUEL TANK

BACKGROUND OF THE INVENTION

1. Field of the Invention

The present invention relates in general to lids of fuel tanks, and more particularly to the lids of a type that has external parts, such as a fuel feed pipe, an electric wiring, a fuel vapor pipe and the like, mounted thereon or therein.

2. Description of the Related Art

In order to clarify the task of the present invention, one conventional lid of such type will be briefly described in the following, which is disclosed in Japanese Laid-open Patent Application (Tokkaihei) 10-299599.

The lid of the publication is constructed and sized to be put in an opening of an automotive fuel tank in a manner to cover the opening. The lid has a fuel feed pipe installed therethrough. In operation, fuel in the tank is led to an engine of the vehicle through the fuel feed pipe. Besides the fuel feed pipe, other external parts, such as electric wiring, fuel vapor pipe and the like tend to be mounted to the lids of the fuel tank. The wiring is used for electrically connecting an electric device in the fuel tank with an electric device arranged outside the fuel tank, and the fuel vapor pipe is used for conveying a fuel vapor produced in the fuel tank to a carbon canister installed in an engine room of an associated motor vehicle.

SUMMARY OF THE INVENTION

Because of the external parts mounted on or in the lid, it is difficult to provide the lid with a compact or small sized structure, which causes a difficulty in installing an assembly of the fuel tank in a motor vehicle, particularly when the vehicle has a limited space for mounting the assembly. The difficulty in making the lid of such type small also appears when the lid has an electric connector (or plug housing) mounted thereon and an electric wiring embedded and extending therein to connect to terminal elements of the electric connector.

Accordingly, an object of the present invention is to provide a lid of fuel tank, which is compact in size irrespective of mounting of external parts thereon.

In accordance with a first aspect of the present invention, there is provided a lid of a fuel tank, which comprises a lid body constructed of a molded plastic and shaped and sized to be put in an opening formed in a wall of the fuel tank, the lid body having a first portion that is exposed to the interior of the fuel tank when the lid is put in the opening of the wall and a second portion that is projected laterally from a major portion of the lid body over a peripheral area of the opening of the wall when the lid is put in the opening of the wall; and a wiring embedded and extending in the lid body, the wiring having a first end exposed to the outside of the lid body from the first portion of the lid body and a second end exposed to the outside of the lid body from the second portion of the lid body.

In accordance with as second aspect of the present invention, there is provided a lid of a fuel, which comprises a lid body constructed of a molded plastic and shaped and sized to be put in an opening formed in a wall of the fuel tank, the lid body having a first position that is exposed to the interior of the fuel tank when the lid is put in the opening of the wall, a second portion that is projected laterally from a major portion of the lid body over a peripheral area of the opening of the wall when the lid is put in the opening of the wall and a third portion that is positioned opposite to the first portion and exposed to the outside of the fuel tank when the lid is put in the opening of the wall; a wiring embedded and extending in the lid body, the wring having first, second and third ends that are exposed to the first, second and third portions of the lid body respectively; a connector by which the first end of the wiring is connected to a wire harness extending from an electric device installed in the fuel tank; a connector housing integrated to the second portion, the connector housing having therein terminal elements that are connected to the second end of the wiring; and a control circuit housing integrated to the third portion, the control circuit housing containing therein a control circuit that is connected to the third end of the wiring.

SUMMARY OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

For ease of understanding, various directional terms, such as right, left, upper, lower, rightward and the like are used in the following description. However, such terms are to be understood with respect to only a drawing or drawings on which a corresponding part or portion is shown.

Figure 1:
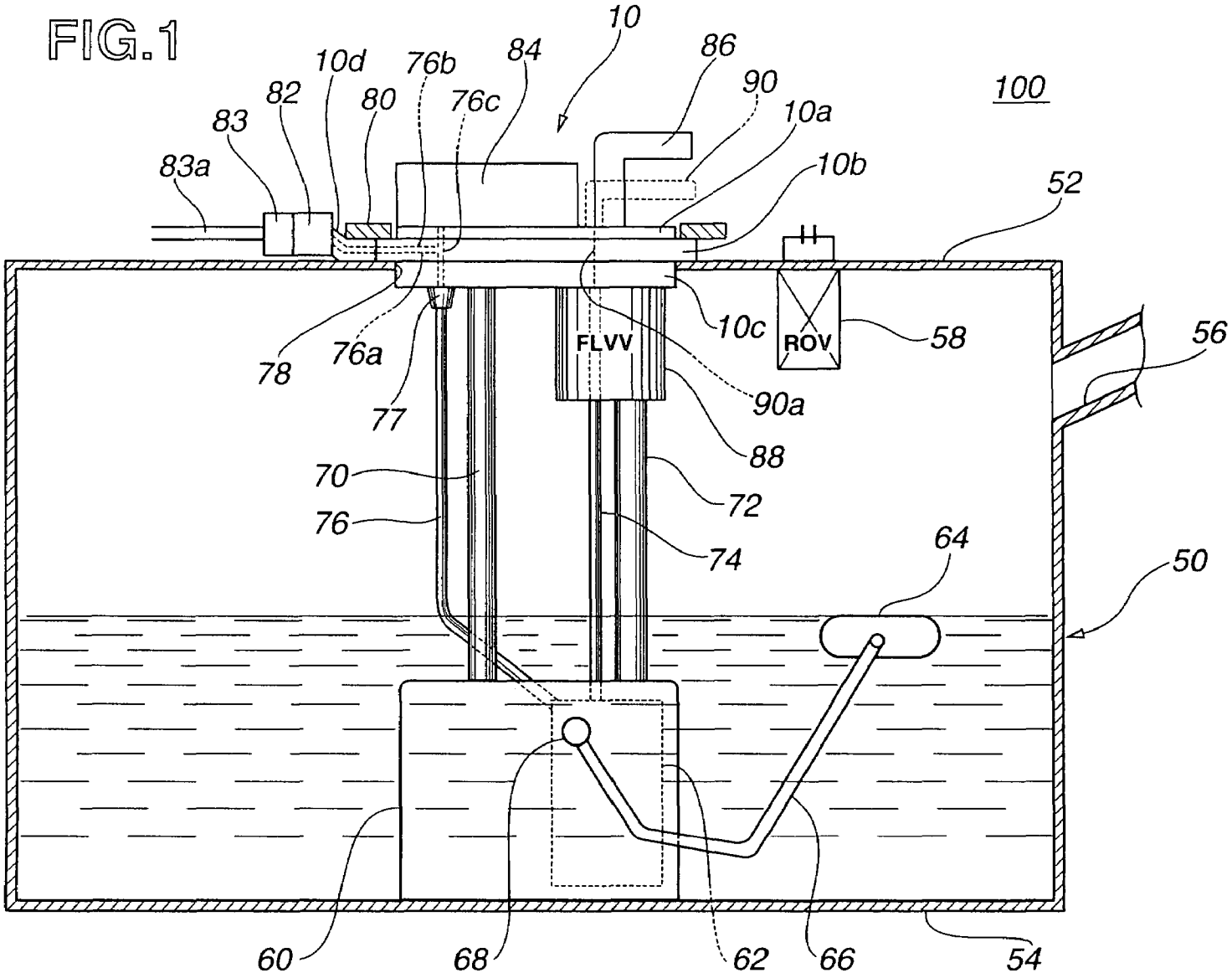
FIG. 1 is a schematic illustration of an automotive fuel tank assembly to which a lid according to the present invention is practically applied.

Referring to FIG. 1, there is shown an automotive fuel tank assembly 100 to which a lid 10 of the present invention is practically applied.

As shown, the automotive fuel tank assembly 100 generally comprises a fuel tank 50 that includes an upper wall 52 and bottom wall 54. The fuel tank 50 is equipped with a fuel inlet opening 56 into which a fuel feeding nozzle (not shown) of a fuel feeding machine is to be inserted for feeding the fuel tank 50 with a fuel.

A roll over valve 58 is connected to the upper wall 52, which functions to permit insertion of outside air into the tank 50 in a normal condition and to stop dangerous outflow of the fuel to the outside through the valve 58 when, due to rollover of the vehicle or the like, the fuel tank 50 is turned upside down.

Mounted on the bottom wall 54 is a fuel box 60 in which an electric fuel pump 62 is tightly installed.

Denoted by numeral 64 is a float that floats in the fuel in the fuel tank 50. The float 64 is connected through an arm 66 to a fuel quantity sensor 68 fixed to the fuel box 60, so that the sensor 68 senses the quantity of the fuel in the tank 50 by measuring the vertical position of the float 64.

From a top of the fuel box 60, there extend two supporting rods 70 and 72 that are led toward the lid 10 of the invention in an after-mentioned manner.

From an outlet port of the fuel pump 62, there extends a fuel tube 74 which is led and connected to the lid 10 of the invention, in an after-mentioned manner.

From the electric fuel pump 62 and the fuel quantity sensor 68, there extends a wire harness 76 which is led and connected to the lid 10 of the invention, in an after-mentioned manner.

Figure 2:
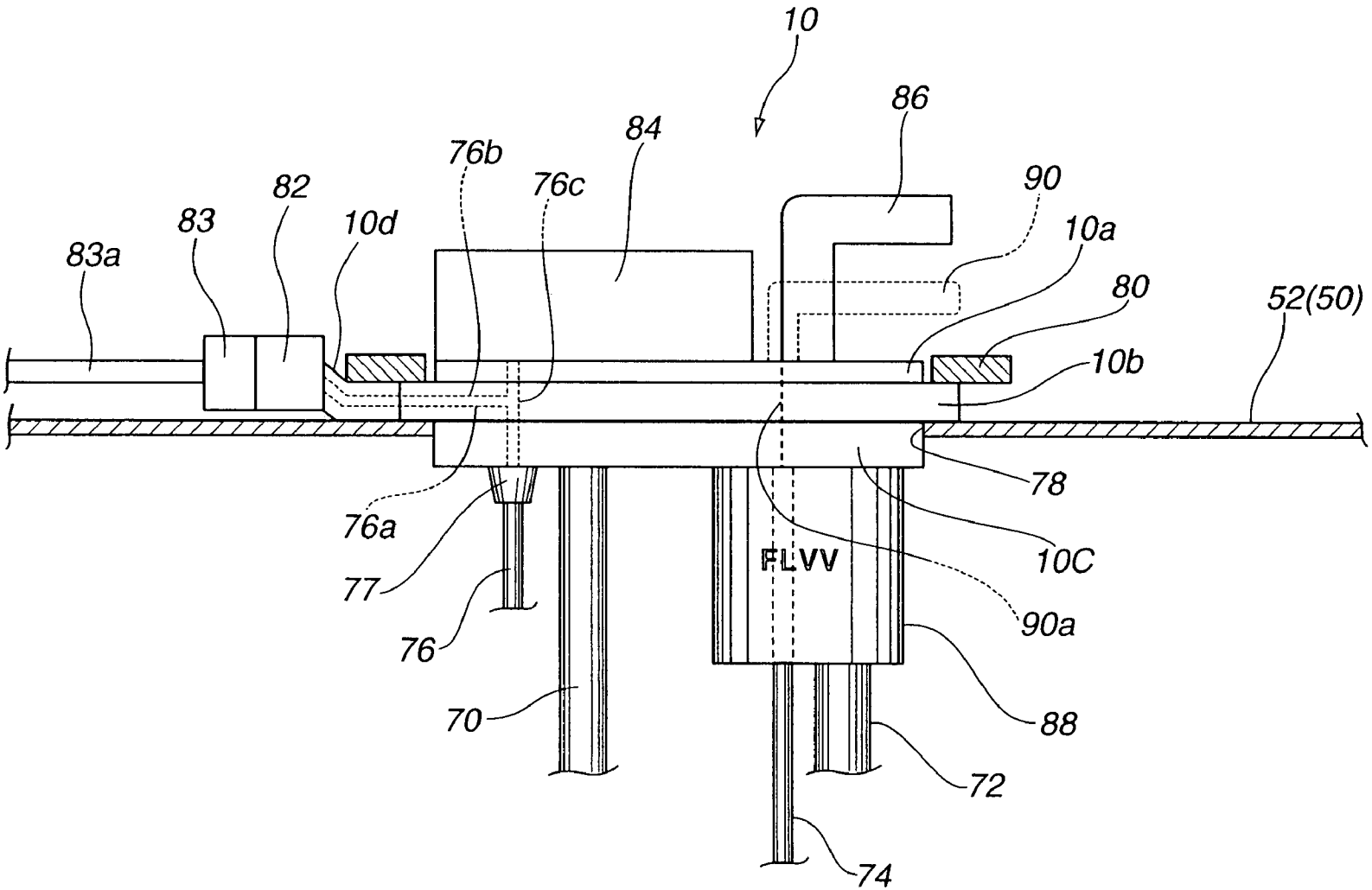
FIG. 2 is an enlarged side view of the lid according to the present invention.
Figure 3:
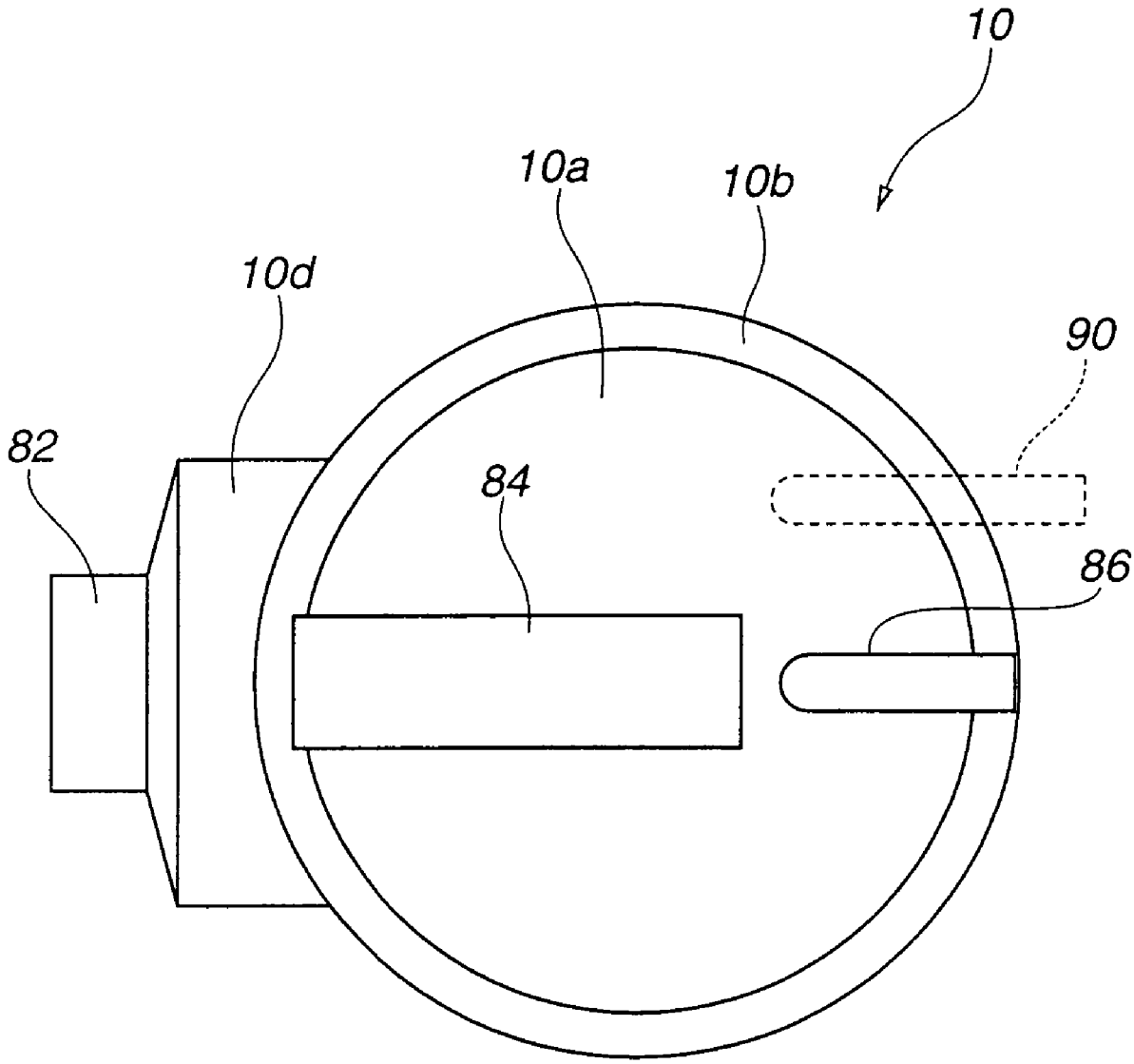
FIG. 3 is a plan view of the lid according to the present invention.

Referring to FIGS. 2 and 3, particularly FIG. 2, there is shown the detail of the lid 10 of the present invention.

For receiving the lid 10, the upper wall 52 of the fuel tank 50 is formed with a circular opening 78.

The lid 10 is constructed of a fiber-reinforced molded plastic and generally comprises a cylindrical upper base portion 10*a*, an annular flange portion 10*b* concentrically provided by the cylindrical base portion 10*a*, a cylindrical lower base portion 10*c* projected downward from the upper base portion 10*a*, and a side bracket portion 10*d* projected radially outward from a part of the annular flange portion 10*b*. It is to be noted that the portions 10*a*, 10*b*, 10*c* and 10*d* are integrated to constitute an integral construction of the lid 10.

As is seen from FIG. 2, upon setting on the upper wall 52 of fuel tank 50, the cylindrical lower base portion 10*c* of the lid 10 is neatly received in the circular opening 78 of the upper wall 52 having the annular flange portion 10*b* seated on a peripheral edge of the opening 78 of the upper wall 52.

For tightly and detachably fixing the lid 10 to the upper wall 52, a lock ring 80 put on the annular flange portion 10*b* is engaged with a grooved annular bank (not shown) formed on the upper wall 52 around the circular opening 78. As shown in FIG. 2, for achieving optimal fixing work by the lock ring 80, the upper surface of the annular flange portion 10*b* is flush with that of a radially inside part of the side bracket portion 10*d*.

In the present invention, the following five plastic parts 82, 84, 86, 88 and 90 are integrated to the lid 10. That is, the above-mentioned portions 10*a*, 10*b*, 10*c* and 10*d* and the following five parts 82, 84, 86, 88 and 90 are all integrated to constitute a single plastic unit that is the lid 10.

Denoted by numeral 82 in FIG. 2 is a plug housing that is integrally connected to the side bracket portion 10*d*. The plug housing 82 has therein terminal elements (not shown) to which wires 76*a*,76*b* and 76*c* are connected. The terminal elements may be of lead wire type, connector type or land type.

As shown in the drawing, the wires 76*a*, 76*b* and 76*c* are embedded in the lid 10 while extending in and through the upper base portion 10*a*, the annular flange portion 10*b*, the cylindrical lower base portion 10*c* and the side bracket portion 10*d*. As shown, some of the wires 77*a*, 76*b* and 76*c* are connected to the above-mentioned wire harness 76 that extends from the electric fuel pump 62 and the fuel quantity sensor 68. For such connection, a connector 77 is used.

Each of the wires 76*a*, 76*b* and 76*c* is of a plate metal type.

The plug housing 82 is detachably connected to a socket housing 83 to which a wire harness 83*a* from an engine control unit, a power source (viz., battery) and the like is connected.

In the illustrated example, the plug housing 82 is somewhat raised from the upper wall 52 of the fuel tank 50 to have a certain clearance therebetween. For this raised arrangement, a radially outer part of the side bracket portion 10*d* is somewhat raised relative to a major portion of the same, as shown.

Denoted by numeral 84 is a housing for a control circuit, which is integrally mounted on the upper base portion 10*a*. As is seen from the drawing, some of the wires 76*a*, 76*b* and 76*c* are led to the control circuit installed in the housing 84. As shown in FIG. 3, the housing 84 is rectangular in shape when viewed from the above.

Referring back to FIG. 2, denoted by numeral 86 is a fuel vapor pipe that has a lower end exposed to the interior of the fuel tank 50 through an after-mentioned fuel limited ventilation valve (FLVV) 88. Although not shown, a fuel vapor tube extending from a carbon canister installed in an engine room is connected to the fuel vapor pipe 86. That is, a fuel vapor produced in the fuel tank 50 is led to and adsorbed by the carbon canister, and upon operation of an associated engine, the vapor is released from the canister and led into the intake system of the engine to be burnt. As shown in FIG. 3, an upper horizontal part of the fuel vapor pipe 86 extends in the same direction as the computer circuit housing 84.

Denoted by numeral 88 is the fuel limited ventilation valve (FLVV) that has an upper end integrally connected to the cylindrical lower base portion 10*c*. An upper end of the above-mentioned supporting rod 72 supports the bottom wall of the valve 88 through a spring member (not shown). Also, an upper end of the other supporting rod 70 supports the lower base portion 10*c* of the lid 10 through a spring member (not shown).

The fuel limited ventilation valve 88 functions to shut off the passage of the fuel vapor pipe 86 when, under fuel feeding by the fuel feeding machine, the amount of the fuel reaches a predetermined upper limit.

Denoted by numeral 90 is a fuel pipe that is illustrated by a dotted line. The fuel pipe 90 is integrally mounted on the cylindrical upper base portion 10*a*. Between a lower end of the fuel pipe 90 and an upper end of the above-mentioned fuel tube 74, there extends a fuel passage 90*a* that is formed in and through the lid body of the lid 10. For detachable connection between the fuel tube 74 and the fuel passage 90*a*, a connector (not shown) is used. As shown, the passage 90*a* extends perpendicular to a major surface of the lid body of the lid 10, and the fuel pipe 90 is positioned just above the upper end of the fuel tube 74.

As will be understood from FIG. 1, under operation of the associated motor vehicle, the electric fuel pump 62 is controlled by the control circuit installed in the housing 84, which circuit processes various information signals fed thereto through the wire harness 83*a*. Due to operation of the pump 62, the fuel is fed to the engine through the fuel tube 74, the fuel passage 90*a* formed in the lid 10, the fuel pipe 90 raised from the lid 10 and a fuel carrying tube (not shown). Lowering of the float 64 due to reduction of the fuel in the fuel tank 50 is sensed by the sensor 68 and this sensed information in quantity of the fuel is led to the engine control unit through the wire harness 76 and the other wire harness 83*a*. The roll over valve (viz., ROV) 58 compensates a pressure reduction in the fuel tank 50 by permitting insertion of outside air into the tank 50. However, if, due to rollover of the vehicle or the like, the fuel tank 50 is severely inclined or turned up side down, the valve 58 shuts off the fluid communication between the interior of the tank 50 and the outside of the tank 50. Fuel vapor produced in the fuel tank 50 is led through the fuel limited ventilation valve (FLVV) 88, the fuel vapor pipe 86 and the fuel vapor tube (not shown) to the carbon canister installed in the engine room of the vehicle. When, under fuel feeding by the fuel feeding machine, the amount of the fuel reaches a predetermined upper limit, the fuel limited ventilation valve (FLW) 88 shuts off the passage of the fuel vapor pipe 86.

In the following, advantageous features of the lid 10 of the invention will be described.

First, the wires 76*a*, 76*b* and 76*c* are all embedded in the lid 10 and some 76*a* and 76*b* of them extend laterally to the side bracket portion 10*d* through a part of the annular flange portion 10*b*. This means that the upper flat area of the upper base portion 10*a* has no need of preparing a space and an opening for drawing out the wires 76*a* and 76*b*. In other words, the control circuit housing 84, the fuel vapor pipe 86 and the fuel pipe 90 have an increased freedom in layout on the upper base portion 10*a*.

Second, the plug housing 82 is connected to the side bracket portion 10*d* that projects laterally from the lid 10, and the wires 76*a* and 76*b* extend laterally in the lid 10 and the side bracket portion 10*d* toward the plug housing 82. This means that the lid 10 has an upper mounting space that is increased by a degree corresponding to the size of the plug housing 82. In other words, the lid can have a sufficient upper surface for mounting thereon various parts.

Third, the plug housing 82 is integrally connected to the side bracket portion 10*d* that is tightly pressed against the upper wall 52 of the fuel tank 50 by the lock ring 80. This means that the plug housing 82 is stably and tightly held in position, and thus, manual work for fitting the socket housing 83 to the plug housing 82 as well as the work for detaching the socket housing 83 from the plug housing 82 are smoothly and reliably carried out. If the plug housing 82 is mounted on the upper base portion 10*a* of the lid 10, such smooth and reliable fitting and detaching are not expected.

In the following, modification of the present invention will be described.

First, if possible, an outer surface of the lid 10 may be coated with an oil proof plastic layer.

Second, the plug housing 82 may be a separate member. In this case, the plug housing 82 is secured to the side bracket portion 10*d* by means of bolts or the like.

Third, if desired, the two supporting rods 70 and 72 may be securely connected to the lid 10. In this case, the fuel box 60, the fuel pump 62 and the mechanism 66 and 68 of the float 64 constitute a so-called in-tank module that hangs down into the fuel tank 50 from the lid 10. Furthermore, if desired, a pressure regulator for regulating a discharge pressure of the pump 62, a fuel filter for filtering the fuel discharged from the pump 62, and a suction filter for filtering the fuel fed to the pump 62 may be installed in the in-tank module.

The entire contents of Japanese Patent Application 2004-208530 filed Jul. 15, 2004 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A lid of a fuel tank, comprising:

a lid body constructed of a molded plastic for fitting in an opening formed in a wall of the fuel tank, the lid body having a first portion that is exposed to the interior of the fuel tank when the lid is put in the opening of the wall, a second portion that is projected laterally from a major portion of the lid body over a peripheral area of the opening of the wall when the lid is put in the opening of the wall and includes an annular flange portion and an integrally formed side bracket portion which projects radially outward from the annular flange portion, and a third portion positioned opposite to the first potion so as to be exposed to an outside of the fuel tank when the lid is put in the opening of the wall;

a wiring embedded, molded within and extending in the lid body, the wiring having a first end exposed to the outside of the lid body from the first portion of the lid body and a second end exposed to the outside of the lid body from the second portion of the lid body, the second end of the wiring extending laterally to the side bracket portion through the annular flange portion;

a connector for connecting the first end of the wiring to a wire harness extending from an electric device installed in the fuel tank; and a plug housing to the side bracket portion of the second portion, the plug housing having therin terminal elements that are connected to the second end of the wiring.

2. A lid as claimed in claim 1, wherein the wiring further comprises a third end that is exposed to the third portion of the lid body.

3. A lid as claimed in claim 2, further comprising a control circuit housing integrated with the third portion of the lid body, the control circuit housing containing therein a control circuit that is connected to the third end of the wiring.

4. A lid as claimed in claim 1, in which the terminal elements are of a lead line type.

5. A lid as claimed in claim 1, in which the terminal elements are of a connector type.

6. A lid as claimed in claim 1, in which the terminal elements are of a land type.

7. A lid as claimed in claim 1, in which the wiring comprises a plurality of wires, each being of a plate metal type.

8. A lid as claimed in claim 1, further comprising:

a fuel vapor pipe integrated with the third portion of the lid body, the fuel vapor pipe having one end that is exposed to the interior of the fuel tank through a passage formed in the lid body when the lid body is put in the opening of the wall and the other end that is to be connected to a carbon canister.

9. A lid as claimed in claim 8, further comprising:

a fuel limited ventilation valve integrated with the first portion of the lid body and connected with the fuel vapor pipe in such a manner as to shut off a passage of the fuel vapor pipe when the amount of the fuel a predetermined upper limit in the fuel tank.

10. A lid as claimed in claim 9, further comprising:

a fuel pipe integrated with the third portion of the lid body, the fuel pipe having one end that is connected through a fuel passage formed in the lid body to a fuel tube leading to a fuel pump installed in the fuel tank and the other end that is to be connected to an intake system of an associated engine.

* * * * *